US007597318B2

(12) United States Patent
Moriwaki et al.

(10) Patent No.: US 7,597,318 B2
(45) Date of Patent: Oct. 6, 2009

(54) SHEET MATERIAL ACCUMULATING APPARATUS

(75) Inventors: Toshiyuki Moriwaki, Ibaraki (JP); Kenji Mishima, Ibaraki (JP); Haruhiro Otsuka, Ibaraki (JP); Hitoshi Katsuragawa, Ibaraki (JP)

(73) Assignee: Gunze Limited, Ayabe-Shi, Kyoto (JP)

( * ) Notice: Subject to any disclaimer, the term of this patent is extended or adjusted under 35 U.S.C. 154(b) by 110 days.

(21) Appl. No.: 11/921,939

(22) PCT Filed: May 23, 2006

(86) PCT No.: PCT/JP2006/310206

§ 371 (c)(1),
(2), (4) Date: Dec. 11, 2007

(87) PCT Pub. No.: WO2007/007474

PCT Pub. Date: Jan. 18, 2007

(65) Prior Publication Data

US 2009/0045568 A1 Feb. 19, 2009

(30) Foreign Application Priority Data

Jul. 7, 2005 (JP) ..... 2005-199188

(51) Int. Cl.
*B65H 29/00* (2006.01)

(52) U.S. Cl. ..... 271/185; 271/186; 271/207

(58) Field of Classification Search ..... 271/185, 271/186, 207

See application file for complete search history.

(56) References Cited

U.S. PATENT DOCUMENTS

| | | | | |
|---|---|---|---|---|
| 2,841,394 | A * | 7/1958 | Stobb | 271/185 |
| 4,245,832 | A * | 1/1981 | Klenk et al. | 271/185 |
| 5,415,385 | A * | 5/1995 | Newsome et al. | 270/58.25 |
| 6,349,933 | B1 * | 2/2002 | Scheffer et al. | 271/177 |
| 6,793,212 | B2 * | 9/2004 | Holbrook | 271/2 |
| 2004/0080096 | A1 * | 4/2004 | Holbrook | 271/185 |

(Continued)

FOREIGN PATENT DOCUMENTS

DE 27 21 441 A1 11/1978

(Continued)

*Primary Examiner*—David H Bollinger
(74) *Attorney, Agent, or Firm*—Birch, Stewart, Kolasch & Birch, LLP

(57) ABSTRACT

A sheet material accumulating apparatus for accumulating a sheet material W into an accumulated bundle P by arranging it in a mutually overlapping state is configured to be able to suppress an enlargement, a higher tallness, more complication, etc. of the apparatus and attain a curtailment of various costs, including a manufacture cost.

The apparatus has a primary conveyer 2, a second conveyer 3, and an accumulation unit 4, the accumulation unit 4 has a posture conversion unit 35 for converting the sheet material W in a flatted posture into that in a standing posture, a descend conveyer unit 36 for conveying the sheet material W downward while keeping the standing posture, and a table top 7 for accumulating the received sheet material W sequentially while supporting it in a standup posture; the primary conveyer 2 has a flat conveyance plane 6 at a substantially same height as the table top 7; and the secondary conveyer 3 twists the sheet material W along a conveyance direction so that top and bottom thereof may be inverted while it is conveyed in a rise inclined direction.

8 Claims, 8 Drawing Sheets

U.S. PATENT DOCUMENTS

| | | | | |
|---|---|---|---|---|
| 2004/0164483 | A1* | 8/2004 | Focke et al. | 271/264 |
| 2004/0207146 | A1* | 10/2004 | Engarto et al. | 271/184 |

FOREIGN PATENT DOCUMENTS

| | | | |
|---|---|---|---|
| GB | 1593010 | | 7/1981 |
| JP | 53-145270 | A | 12/1978 |
| JP | 57-189949 | A | 11/1982 |
| JP | 10-35984 | A | 2/1998 |
| JP | 2000-118511 | A | 4/2000 |
| JP | 2003-20153 | A | 1/2003 |

* cited by examiner

SHEET MATERIAL ACCUMULATING APPARATUS

TECHNICAL FIELD

The present invention relates to a sheet material accumulating apparatus.

BACKGROUND ART

There is already known a sheet material accumulating apparatus for accumulating printed sheets (they may be a handbill etc. and may be one printed sheet or a "folded book" obtained by folding it in two or more) printed by a rotary press into a columnar body by arranging them in a mutually overlapping state while being aligned in orientation, and in some cases, including processing of binding an accumulated bundle of this columnar body (hereinafter this bundle is referred to as "accumulated bundle" and any object that can be made into an accumulated bundle including the printed sheets and the folded book is referred to as a "sheet material") with binding band (for example, see patent documents 1 and 2).

An apparatus that is called a "vertical type" among the sheet material accumulating apparatuses of this kind has a posture conversion unit for converting the sheet material in a flatted posture into that in a standing posture by guiding it from its one end side to a downward flow, and a table top that waits the sheet material at a lower position of the posture conversion unit, supports the arrived sheet material sequentially in a standup posture, and accumulates it in a longitudinally arranged state.

In many cases, the sheet material sent out from the rotary press etc. is often in an overlap posture that a head side in a conveyance direction is on a top in the overlapping relation and a back end side in the conveyance direction is on a bottom in the overlapping relation. On the other hand, the sheet material arriving at the table top needs to be always positioned to the most back end plane referring to the accumulated bundle being accumulated on the table. For this purpose, it is necessary to invert top and bottom of the sheet material (up side down) so that regarding the overlap posture of the sheet material, a head side in the conveyance direction may be on a bottom in the overlapping relation and a back end side in the conveyance direction is on the top in the overlapping relation before the sheet material arrives at the posture conversion unit.

Therefore, conventionally, the carrying-in path of the sheet material from the rotary press is set such that the sheet material is temporarily guided to a lower part of this sheet material accumulating apparatus, allowing it to pass under the apparatus, makes it take a U-turn in a longitudinal direction so that it may become a upward somersault state after that, and makes it arrive at the posture conversion unit.

On the other hand, in the case where a binding processing unit is provided at the downstream position of the table top, since this binding processing unit may be intervened by a manual work for a finishing inspection of the accumulated bundle and the binding band, carrying out of the accumulated bundle, maintenance for the binding mechanism, etc., a height of this binding processing unit is set to be about at a level of waist position and its peripheral part of an operator. Therefore, with the intention of matching the table top with this binding processing unit in height, the table top is set at the level of waist position and its peripheral part of the operator.

Patent document 1: Japanese Unexamined Patent Publication No. 2000-118511

Patent document 2: Japanese Unexamined Patent Publication No. HEI10-35984

DISCLOSURE OF THE INVENTION

Problem to be Solved by the Invention

If the carrying-in path of the sheet material is made with a structure of passing it through a lower part of the apparatus as a preliminary stage of making the sheet material take a U-turn in the longitudinal direction as described above, an enlargement and a higher tallness of the apparatus will be incurred inevitably. Needless to say, the enlargement of the apparatus leads to an expansion of an installation space.

Moreover, in order to get the carrying-in path of sheet material through the lower part of the apparatus, it is necessary to a lower intentionally this carrying-in path to a lower level near the floor surface and if the sheet material conveyance path at the upstream side thereof is at a tall level higher than the height of an operator (near ceiling in a factory, etc.) or at a level of waist position or its peripheral part of the operator, such a configuration leads to an enlargement of not only the sheet material accumulating apparatus but also peripheral equipment (namely, waste of a space).

Moreover, if the height of the table top is set to the level of waist position or its peripheral part of the operator, mechanisms inside the apparatus including the sheet material carrying-in path that need to be gotten through a lower part of the apparatus must be compressed in the longitudinal direction, which also incurs a complication of the structure. This structure also leads to various kinds of problems, such as making maintenance difficult.

Such enlargement and complication of the apparatus also lead to increase of costs of transportation, installation, etc. as well as increase of a manufacture cost of the apparatus itself, and are unsuitable. Especially, the enlargement of the apparatus leads to useless waste of a space in a factory that allows only limited installation sites, and in some cases, this problem will develop into a situation that disables its installation, and therefore there is a request of evading it as much as possible.

The present invention is made in view of the above-mentioned circumstances and has as its object to provide a sheet material accumulating apparatus for accumulating a sheet material presenting a columnar body obtained by arranging the sheet material in a mutually overlapping state that is configured to be able to suppress the enlargement, the higher tallness, more complication, etc. and attain a curtailment of various costs including the manufacture cost.

Means Adapted to Solve the Problems

In order to attain the object, the present invention takes measures to incorporate the following means.

That is, regarding the sheet material accumulating apparatus according to the present invention, a primary conveyer, a secondary conveyer, and an accumulation unit are arranged in this order following a conveyance flow of the sheet material. Among these, the accumulation unit has a posture conversion unit that guides the sheet material being in a flatted posture to a downward flow from its one end side and converts it into that in a standing posture, and a table top that waits the sheet material at a lower position of this posture conversion unit and accumulates the sheet material that arrived there in a longitudinally arranged state while supporting it sequentially in a standup posture.

On the other hand, the primary conveyer has a flat conveyance plane for holding the sheet material in a flatted posture at a substantially same height as the table top of the accumulation unit.

Moreover, the secondary conveyer is made able to convey a sheet material received from the primary conveyer in a rise inclined direction so that it can be delivered to the posture conversion unit of the accumulation unit, and has the first guide belt and the second guide belt that sandwich the sheet material and convey it. Further, these first guide belt and second guide belt are twisted along a conveyance direction so as to invert the top and bottom of the sheet material being sandwiched while maintaining parallelism thereof.

The first guide belt of the two becomes one that first supports the sheet material having been transferred from the primary conveyer to the secondary conveyer, while at this time the second guide belt comes to push the sheet material downward (the first guide belt). Moreover, when sending out the sheet material from the secondary conveyer to the accumulation unit, the second guide belt becomes one that supports the sheet material contrarily, and at this time the first guide belt press the sheet material against the lower constituent (the second guide belt).

Since thus the apparatus is configured to apply a twist on the sheet material being conveyed and invert this sheet material up side down along the conveyance direction by using the secondary conveyer for elevation conveyance provided between the primary conveyer and the accumulation unit, it is not necessary to specially make the sheet material take a U-turn in the longitudinal direction in the carrying-in path of the sheet material. Accompanying this, the need to make the sheet material pass temporality to a lower side of the accumulation unit will be eliminated.

These methods make it possible to suppress the enlargement, the higher tallness, more complication, etc. of the apparatus and also lower various costs including the manufacture cost.

It is preferable to configure the apparatus such that the primary conveyer, the secondary conveyer, and the accumulation unit can each be installed independently. With this specification, it becomes possible to freely connect or disconnect a sheet material conveyance path made up of the primary conveyer, the secondary conveyer, and the accumulation unit.

By configuring the sheet conveyance path in this way, it becomes free to select the secondary conveyer provided between the primary conveyer and the accumulation unit to be either of a curvilinear type that makes the sheet material take a turn curve to the left or right when its conveyance direction is viewed in a plane, or of a straight type that makes the sheet material go straight. Therefore, versatility and the degree of freedom of its installation as a whole of the sheet material accumulating apparatus can be raised.

The primary conveyer and the accumulation unit can be provided in such a way that the conveyance direction of the sheet material be bent to the right or left when its conveyance direction is viewed in a plane. In this case, although the secondary conveyer will be of a curvilinear type having a turn curve to the left or right correspondingly to curvilinear arrangement of the primary conveyer and the accumulation unit. It is preferable that a left/right direction of a twist added to the first guide belt and the second guide belt is in the same direction as the left/right direction of a bent added to the above-mentioned turn curve.

With this configuration, when the sheet material is intended to be turned along the left direction or the right direction turn curve from the primary conveyer to the accumulation unit, curving inertia generated in the sheet material is effectively taken over, as it is, in a twist action when the sheet material is intended to pass through the first guide belt and the second guide belt of the secondary conveyer. Therefore, as a synergy of these actions, conveyance for passing of the sheet material that includes the twist by the secondary conveyer will be performed smoothly.

In a case where the secondary conveyer is specified to be of a straight type that makes the sheet material go straight when its conveyance direction is viewed in a plane, it may be specified to have a conveyer frame for holding the first guide belt and the second guide belt and an installation frame for supporting this conveyer frame.

These conveyer frame and installation frame shall be connected together in a rotation-angle alterable way, setting an intermediate part of the conveyance span in the conveyer frame as a rotation fulcrum. By doing in this way, this conveyer frame becomes alterable freely in the height of both ends of the conveyance direction.

That is, since this configuration enables an inclined angle of the conveyer frame to be adjusted, this will make it possible to adjust the height between the primary conveyer and the secondary conveyer and the height between the secondary conveyer and the accumulation unit. In a case where it is configured that heights of the primary conveyer and the accumulation unit are made independently adjustable, this capability also leads to adjustability in mutual spacing between the primary conveyer and the accumulation unit.

Moreover, if the inclined angle of the conveyer frame is adjustable in this way, the following added values may be generated: this secondary conveyer is diverted as a conveyance conveyer in which the inclined direction is relatively reversed to the present direction (namely, down inclination); or this secondary conveyer is diverted as a horizontal conveyance conveyer.

It is preferable to configure the secondary conveyer such that the first guide belt and the second guide belt are each constructed with belt conveyance means, and at least one of the belt conveyance means is driven to give conveyance driving to the sheet material. By configuring the apparatus as such, the secondary conveyer can transmit conveyance driving to the sheet material efficiently.

It is preferable for a flat conveyance plane of the primary conveyer and a table top in the accumulation unit to be formed at a height of 700 mm to 1100 mm inclusive above a floor on which the operator works in a standup posture. Specifying the plane and the table top in this way enables the operator to acquire environment easy to work in.

That is, if the heights of the flat conveyance plane of the primary conveyer and the table top in the accumulation unit do not reach 700 mm, the operator is forced to work in a locking-down posture, which increases a burden to the waist. Moreover, if the height is over 1100 mm, the operator is required to work with the arm raised higher than the waist, especially in a case where a binding processing unit follows the table top of the accumulation unit, the work becomes very heavy when the accumulated bundle after binding is raised or in other operations.

Effectiveness of the Invention

In the sheet material accumulating apparatus according to the present invention, an enlargement, a higher tallness, more complication, etc. can be suppressed and a curtailment of various costs including the manufacture cost can be attained.

DESCRIPTION OF REFERENCE NUMERALS

Figure 1:
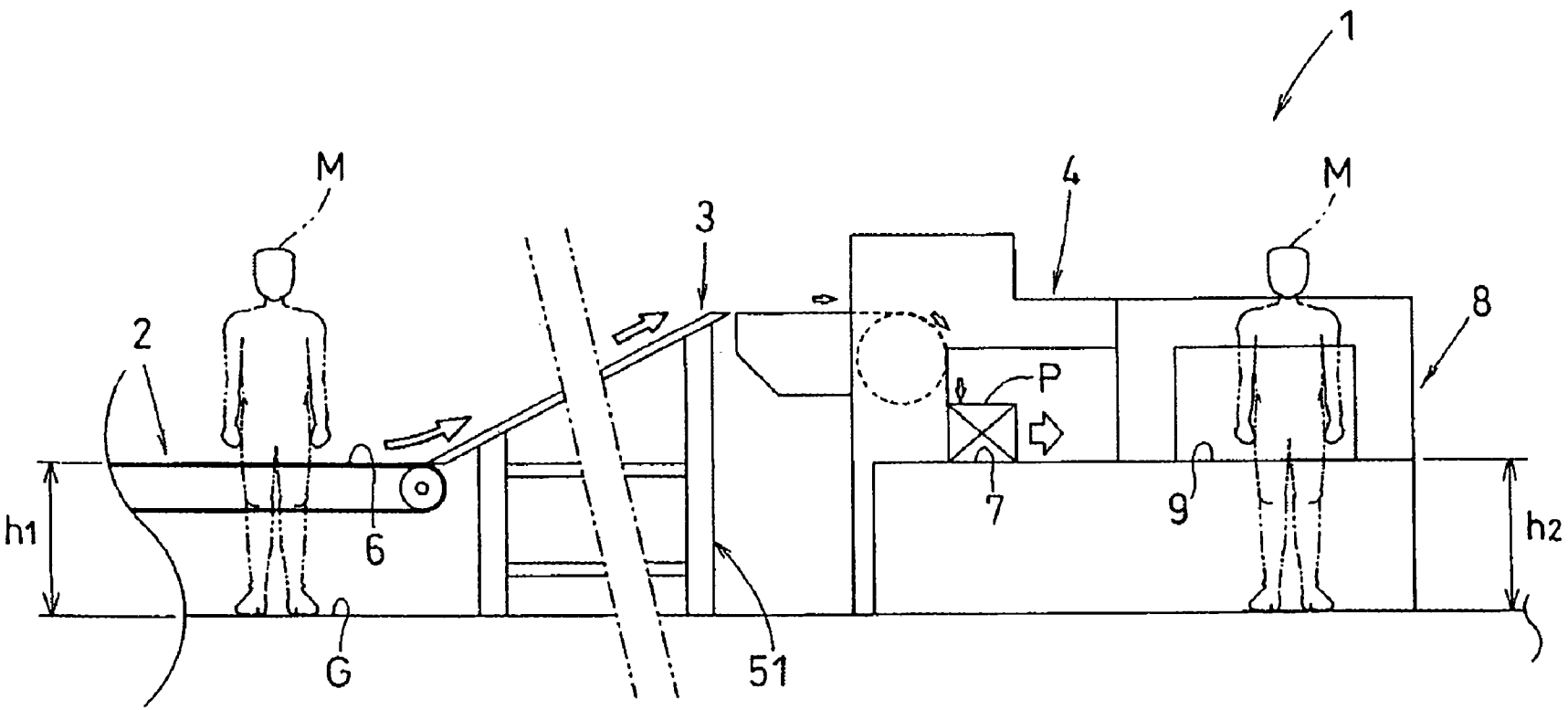
FIG. 1 is a diagram of FIG. 2 in the direction of an arrow A-A.
Figure 2:
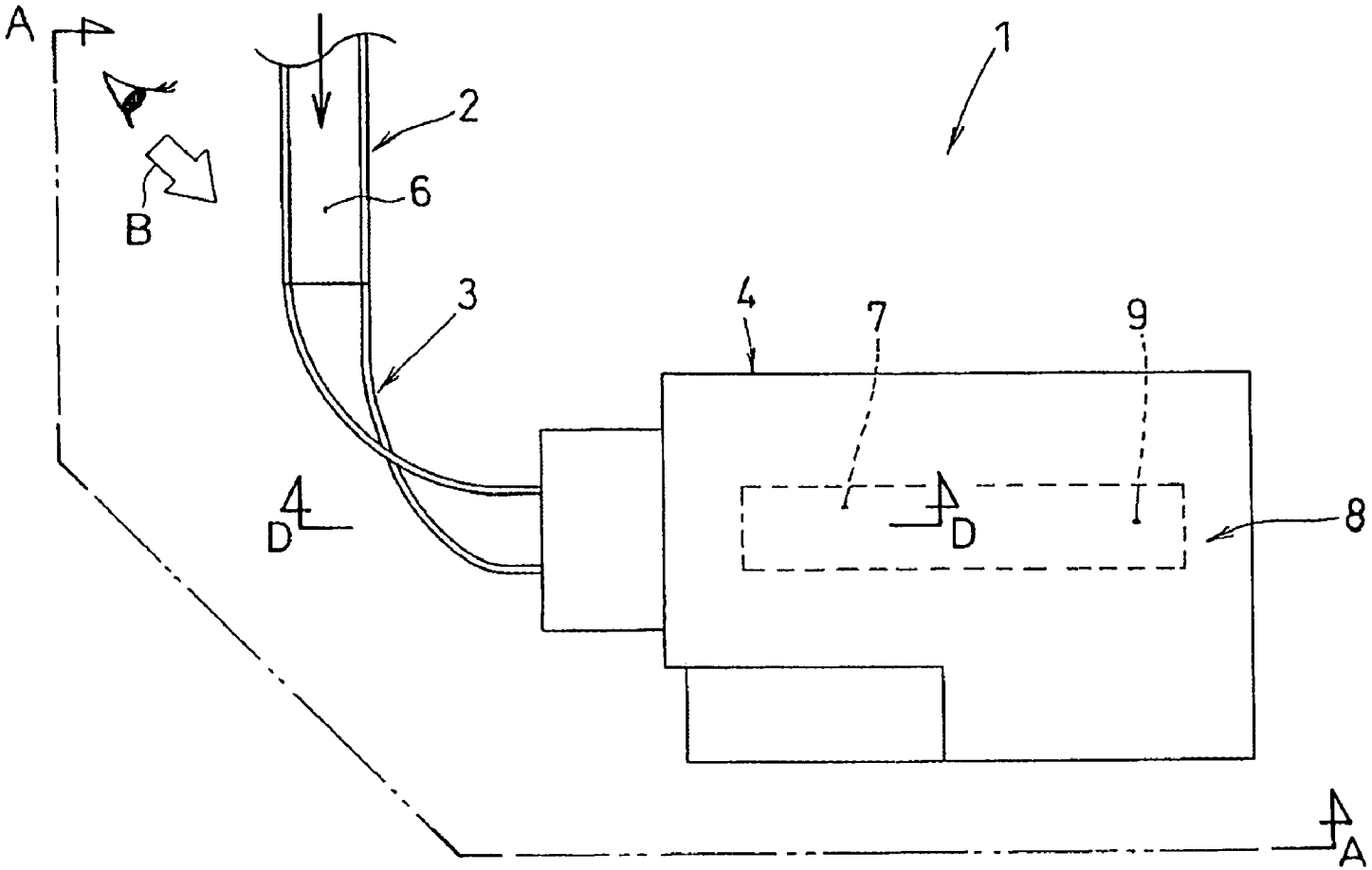
FIG. 2 is a plan view showing one embodiment of the sheet material accumulating apparatus according to the present invention.

1 Sheet material accumulating apparatus
2 Primary conveyer
3 Secondary conveyer
4 Accumulation unit
6 Flat conveyance plane
7 Table top
12 First guide belt
13 Second guide belt
20 Belt conveyance means
21 Belt conveyance means
35 Posture conversion unit
36 Descend conveyance unit
W Sheet material
M Operator
G Floor on which operator stands
P Accumulated bundle

BEST MODE FOR CARRYING OUT THE INVENTION

Hereafter, embodiments of the present invention will be explained referring to the drawings.

FIGS. 1 to 6 show one embodiment of a sheet material accumulating apparatus 1 according to the present invention. As is clear from FIGS. 1 to 3, this sheet material accumulating apparatus 1 is such that a primary conveyer 2, a secondary conveyer 3, and an accumulation unit 4 are arranged in this order following a conveyance flow of a sheet material W.

The primary conveyer 2 and the secondary conveyer 3 continuously convey the sheet material W, such as printed papers, sent out from a rotary press etc. (it may be a handbill etc. that is one printed sheet or a "folded book" obtained by folding it in two or more) in a flatted posture and helps the accumulation unit 4 to taken it in.

Among them, the primary conveyer 2 has its top face formed as a substantially horizontal flat conveyance plane 6. Moreover, the height $h_1$ of this flat conveyance plane 6 is set to be in a range from 700 mm to 1100 mm (inclusive), or further preferably be approximately 800 mm, referring to a floor G on which an operator M stands working in a standup posture facing this primary conveyer 2.

Therefore, since this primary conveyer 2 top face (the flat conveyance plane 6) will correspond to a level of waist position or its peripheral part of the operator M, and this is a height easy to work on for the operator M, it can be utilized as a work station of such works: removing defectives that cause printing fault, breakage, wrinkles out of the sheet material W being conveyed; and sampling out a sample.

On the other hand, the accumulation unit 4 converts the sheet material W in a flatted posture into that in a standing posture by guiding it to a downward flow from its one end side, then supports the sheet material W sequentially in a standup posture by supporting it from a bottom thereof, and accumulates it so that the each sheet material W may become in a mutually overlapping state longitudinally arranged (a fallen sideways columnar body) by shifting it laterally, as it is, by an appropriate amount.

In this accumulation unit 4, a part thereof for supporting the sheet material W from the bottom thereof (in order to support a side face of the accumulated bundle P of the columnar body) is specified to be a substantially horizontal table top 7.

In the present embodiment, the accumulation unit is specified to be one that is provided with a binding processing unit 8 for binding a portion that will be a downstream part of the accumulation unit 4 by circling a binding band on an accumulated bundle P accumulated in the accumulation unit 4. Therefore, the table top 7 that this accumulation unit 4 has is adjusted to have the same height $h_2$ as a processing table top 9 of this binding processing unit 8 so that the table top 7 can send out the accumulated bundle P to the binding processing unit 8 by making it, as it is, move horizontally.

Here, in the binding processing unit 8, manual works, such as finishing inspection of the accumulated bundle P and the binding band, carrying out of the accumulated bundle P, and maintenance for a binding mechanism, are likely to be performed. Therefore, it is required that the height $h_2$ of the processing table top 9 be set to a level of waist position or its peripheral part of the operator M so that it will be convenient to these manual works.

Then, with intention to match the processing table top 7 with the height $h_2$ of the table 9 of this binding processing unit 8, a table top 7 of the accumulation plane 4 is set to be placed at the level of waist position or its peripheral part of the operator M, namely in a height range from 700 mm to 1100 mm inclusive, and further preferably at a height of approximately 800 mm referring to the floor G on which the operator M stands working in the standup posture facing the accumulation unit 4.

As a result of these specifications, a flat conveyance plane 6 of the primary conveyer 2 and the table top 7 of the accumulation unit 4 have approximately the same height (including the same height).

In addition to such a situation, the accumulation unit 4 is required to perform a descend conveyance of the sheet material W from the above toward the table top 7. Therefore, in order that the primary conveyer 2 sends out the sheet material W to the accumulation unit 4, it is necessary to temporarily raise the sheet material W to a level higher than the table top 7. Therefore, the secondary conveyer 3 provided between the primary conveyer 2 and the accumulation unit 4 is specified as an elevation conveyance conveyer for conveying the sheet material W in a rise inclined direction.

Figure 4:
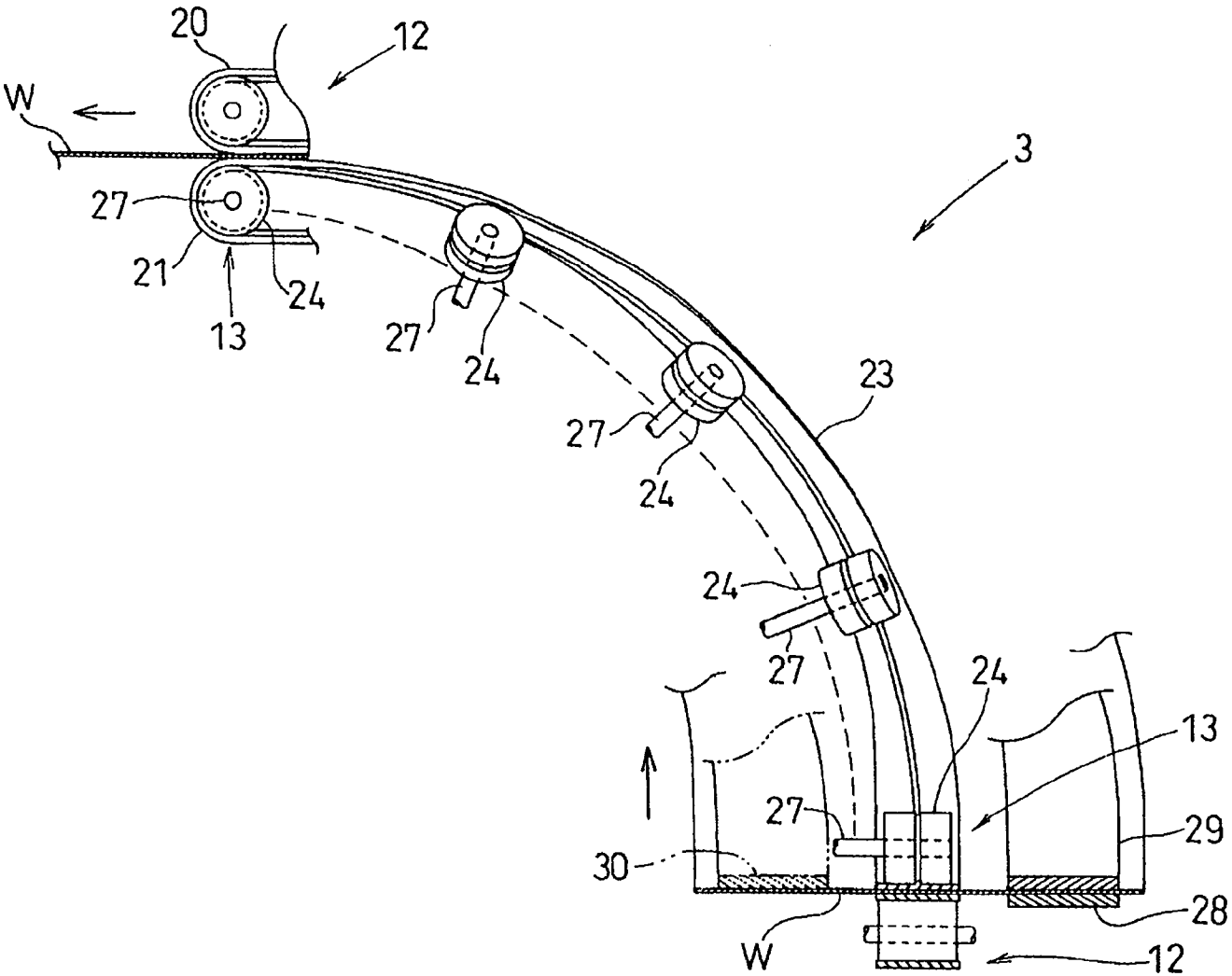
FIG. 4 is a sectional view of FIG. 3 in the direction of an arrow C-C.

As shown in FIG. 4, the second conveyer 3 is configured to convey the sheet material W while sandwiching it from the above and the below and invert it up side down along a conveyance direction by applying the twist to this sheet material W being conveyed.

For this purpose, the secondary conveyer 3 has a first guide belt 12 that abuts a downward plane at the time of receiving the sheet material W from the primary conveyer 2 and a second guide belt 13 that abuts an upward plane of the sheet material W. Since these first guide belt 12 and second guide belt 13 are provided parallel to each other so that a sandwiching state of the sheet material W between the two can be maintained, accompanying a fact that the secondary conveyer 3 is twisted as a whole in the conveyance direction, the second guide belt 13 abuts the downward plane of the sheet material W and the first guide belt 12 abuts the upward plane at the time of delivery by feeding out the sheet material W from the secondary conveyer 3 to the accumulation unit 4.

In the present embodiment, the primary conveyer 2 and the accumulation unit 4 are installed with an arrangement where the conveyance direction of the sheet material W is bent to the left direction when viewed in a plane, and the secondary conveyer 3 is specified to be of a curvilinear type having a turn curve to the left direction correspondingly to the bent arrangement of these primary conveyer 2 and accumulation unit 4.

Then, in relation to this, the first guide belt 12 and the second guide belt 13, following the turn curve as the whole of the secondary conveyer 3, becomes one that has a twist to the left direction similarly.

Therefore, on the sheet material W that takes a left turn curve in the secondary conveyer 3, the first guide belt 12 and the second guide belt 13 cause twist actions in a same direction as that of curving inertia, and as a synergistic effect of them, a conveyance for passing and an up side down inversion by the secondary conveyer 3 will be performed smoothly.

Both the first guide belt 12 and the second guide belt 13 are formed by belt conveyance means 20, 21, respectively. Among them, the belt conveyance means 21 making up of the second guide belt 13 abuts the upward plane of the sheet material W when receiving from the primary conveyer 2, and abuts the downward plane of the sheet material W when transferring to the accumulation unit 4, as described above. Further, it takes charge of convex (mountainous) curve when viewed from the turn curve and a shape of the twist, and exerts mainly an action of backuping the sheet material W when viewed from the up side down inversion action (an action supporting the inner side of a curve) of the sheet material W incident to the twist.

Therefore, the belt conveyance means 21 making up this second guide belt 13 is given a structure that a plurality of guide rollers 24 are provided with a mutually adjacent pitch for an overall length of a spanning span of a belt 23. That is, in between the respective guide rollers 24, there does not occur a large flexion that heads a recess direction in the belt 23, the turn curve and the shape of the twist are assured firmly, and as a result, the sheet material W can be backuped always and surely.

Figure 5:
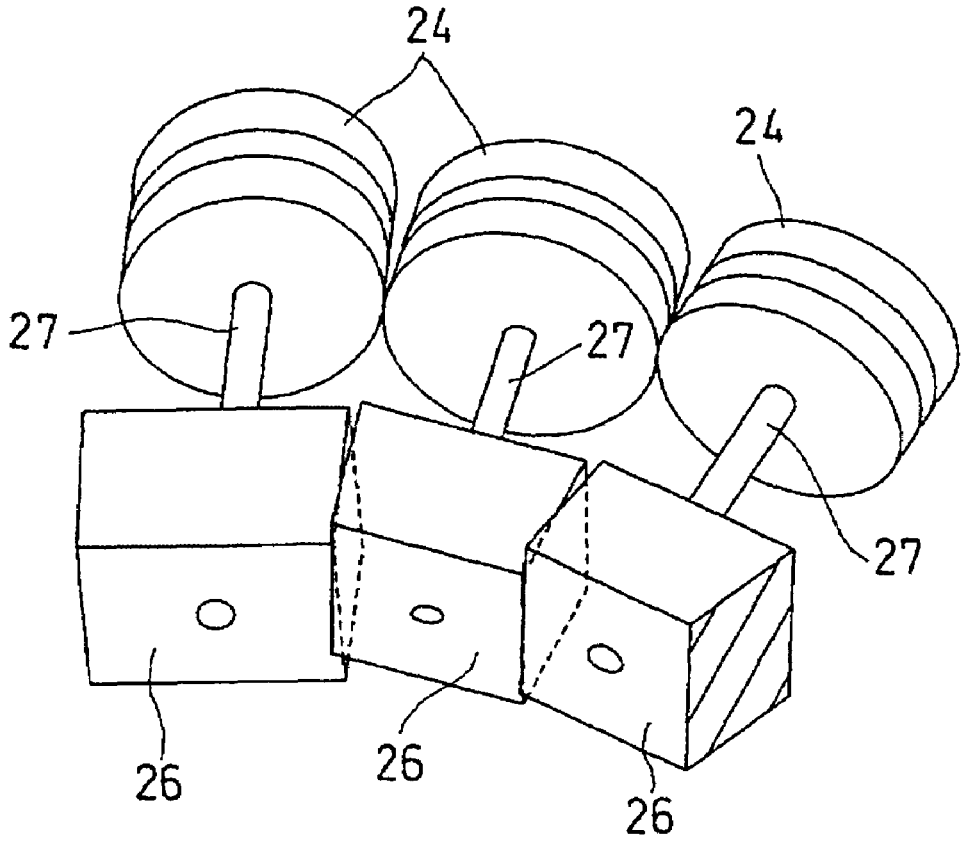
FIG. 5 is a principal part perspective view explaining a belt supporting structure adopted for a first guide belt of a secondary conveyer.

Here, in order to make the guide rollers 24 be held along a desired turn curve line and a twist line, the apparatus is given a structure, as shown in FIG. 5, where a short-cut rod piece 26 is connected by welding etc. and at this time connection planes of the rod pieces 26 are formed to make an angle three-dimensionally, and thereby a three-dimensional bending relation of a predetermined angle is made obtainable among connections of the rod pieces 26, and the relation is used so as to make up a turn curve line and a twist line as a whole. With this preparation, the each rod piece 26 is made to hold a roller shaft 27 in a protruding manner, and the each roller shaft 27 is made to hold the guide roller 24 in a freely rotatable manner.

The adoption of such a structure made it possible to realize a specific shape of the second guide belt 13 relatively easily.

In order to give a conveyance driving to the sheet material W in this secondary conveyer 3, what is necessary is just to drive either one or both of the first guide belt 12 and the second guide belt 13. However, in a case of driving the second guide belt 13, what is necessary is just to rotationally drive one of or a plurality of the above-mentioned guide rollers 24.

Preferably, it is advisable to provide a first guide rail 28 in parallel to the first guide belt 12 and provide a second guide rail 29 in parallel to the second guide rail 13 so that they may be brought into correspondence with a side line of the sheet material W (in this embodiment, the right side line) equivalent to a radial outer side (a direction in which a centrifugal force acts) with respect to the turn curve. In some cases, a guide rail 30 may also be provided in the radial inner side of the turn curve.

Neither the above-mentioned constructional detail of the primary conveyer 2 itself nor the constructional detail of the accumulation unit 4 itself is limited specially. For example, the primary conveyer 2 can be specified to be a belt conveyer in which a plurality thin belts or ban codes are installed in parallel, including a strip belt conveyer, or roller conveyer, or the like. Moreover, it may be of a driving type or of a non-driving type.

Figure 6:
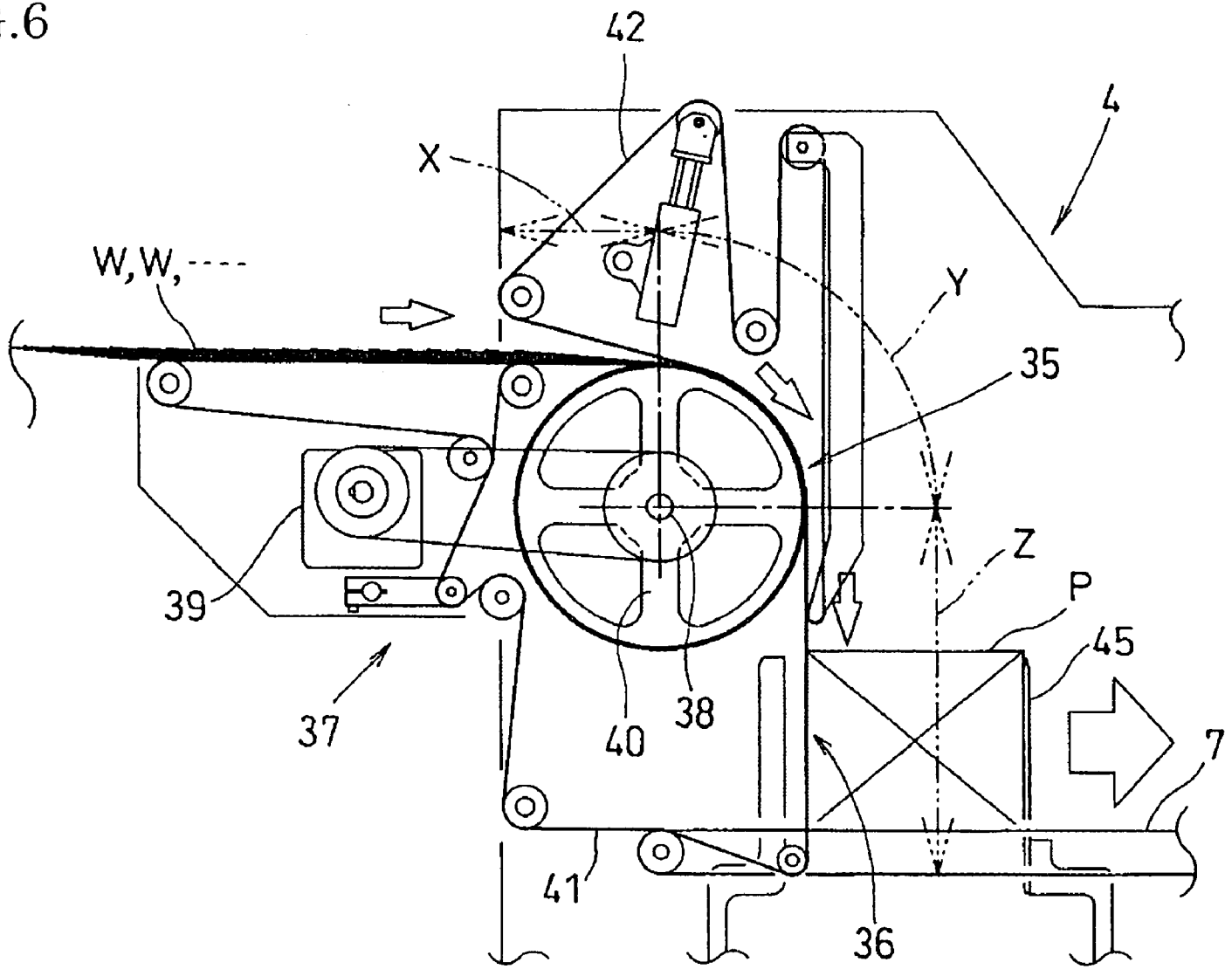
FIG. 6 is a D-D line sectional view (a side view of the accumulation unit) of FIG. 2.

Furthermore, as shown in FIG. 6, the accumulation unit 4 can be specified to be provided with a posture conversion unit 35 and a descend conveyance unit 36 in an upward part in an upstream part of the table top 7.

The posture conversion unit 35 converts the sheet material W being in a flatted posture into that in a standing posture by guiding it to a downward flow from one end side thereof. The descend conveyance unit 36 conveys the sheet material from this posture conversion unit 30, as it is in the standing posture, downward and sends it into the table top 7.

A drum type conveyer 37 can be employed for these posture conversion unit 35 and the descend conveyance unit 36. This drum type conveyer 37 has a drum 40 that rotates in one direction by a drum rotation motor 39 around a rotation shaft 38 whose axial center is placed horizontally as a center, and an inner belt 41 is spanned so as to encircle the drum 40 including a portion that is wound around this drum 40 and installed such that an outer belt 42 contacts a part of this inner belt 41 in a superposition state.

Namely, taking a representation of a dial plane of a clock on the side of the drum 40 in FIG. 6, the inner belt 41 is wound around the drum 40 for a one quarter circumferential part from 12 o'clock to 3 o'clock (Y region), and a transverse feeding region (X region) expanding in a horizontal direction from the position of 12 o'clock with this part located in the middle and a longitudinal feeding region (Z region) expanding in a right downward direction from the position of 3 o'clock are formed.

On the contrary, the outer belt 42 is superposed on the inner belt 41 in a range from a region (Y region) where the inner belt 41 is wound around the drum 40 to a halfway of the longitudinal feeding region (Z region). The sheet material W is sandwiched in a superposition space between this inner belt 41 and the outer belt 42 and is driven to be fed to the same direction together with the inner belt 41 in accordance with the drum 40 being driven to rotate, whereby its conveyance direction is converted from a transverse feeding to a downward feeding.

The table top 7 is provided extending to an upstream side (approximately the right downward of the drum) slightly further than the right downward position of the longitudinal feeding region (Z region) so as to be able to surely receive the sheet material W that is descend-conveyed in a standup posture by the drum type conveyer 37 from the right downward. This table top 7 is formed with a top face of an upper-spanned side of a driving-type conveyance belt obtained by installing a plurality of thin belts in parallel.

This table top 7 is also provided with a holder 45 for prevention of falling down in order to maintain the standup posture of the sheet material W. This holder 45 for prevention of falling down is controlled so as to gradually move in a direction away from the drum type conveyer 37 while loading an appropriate back pressure to the sheet material W side, in synchronization with the sheet material W being accumulated on the table top 7 (the columnar body extending transversely).

Figure 3:
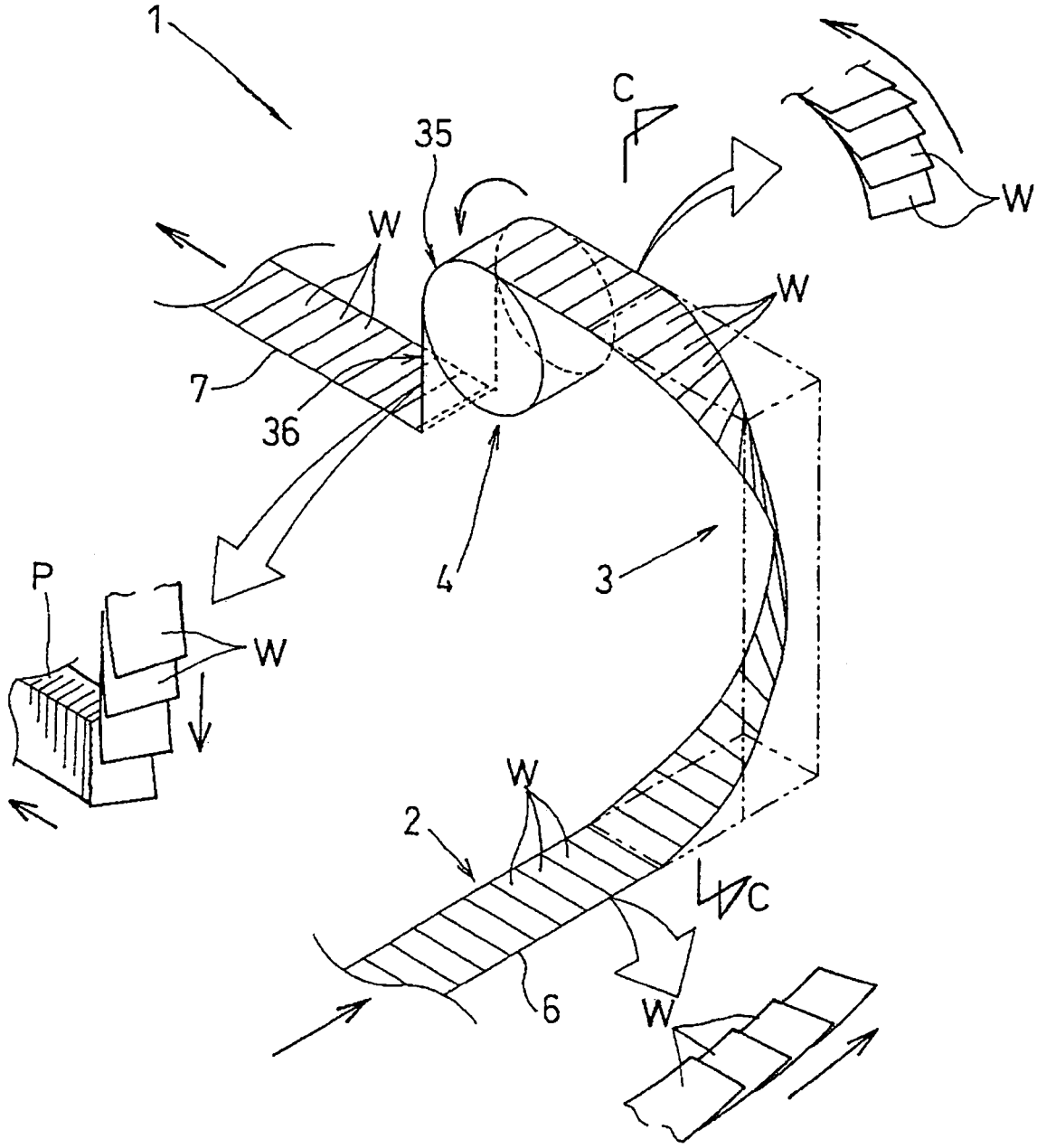
FIG. 3 is a perspective view schematically showing a configuration of a conveyance path along a direction of an arrow B-B of FIG. 2.

In the sheet material accumulating apparatus 1 with such a configuration, as shown in FIG. 3, the sheet material W in the primary conveyer 2 is in a substantially horizontal flatted posture, wherein a head side of the each in the conveyance direction is on the top in the overlapping relation and a back end side in the conveyance direction is on a bottom in the conveyance direction, respectively.

The sheet material W that went through transfer from the primary conveyer 2 to the secondary conveyer 3 in this state is conveyed by this secondary conveyer 3, whereby an overlap posture of the sheet material W is inverted up side down (turned over) at the time of being sent to the accumulation unit 4. That is, in the each sheet material W, the head side in the conveyance direction is on the bottom in the overlapping relation and the back end side in the conveyance direction is on the top in the overlapping relation.

Thus, in the accumulation unit 4, the sheet material W that passes through the posture conversion unit 35 and the descend conveyance unit 36 (a longitudinal feeding region of the drum type conveyer 37 (Z region)) to arrive at on the table top 7 will be always positioned to the most back end plane to the accumulated bundle P being accumulated on the table top 7. Therefore, it is made possible to perform an arrangement of the sheet material W in a mutually overlapping state, longitudinal arranged on the table top 2.

As is clear from detailed description above, the sheet material accumulating apparatus 1 according to the present invention is configured such that the sheet material W being conveyed is given a twist by using the secondary conveyer 3 for elevation conveyance that is provided between the primary conveyer 2 and the accumulation unit 4, thereby the sheet material W is inverted up side down along the conveyance direction, and accordingly it is not necessary to make it take a U-turn in the longitudinal direction. Therefore, this negates the need of making the sheet material W be conveyed for passing to a lower part of the accumulation unit 4 once, and therefore, an enlargement, a higher tallness, more complication, etc. of the apparatus can be suppressed and a curtailment of various costs including the manufacture cost will be attainable.

Figure 7:
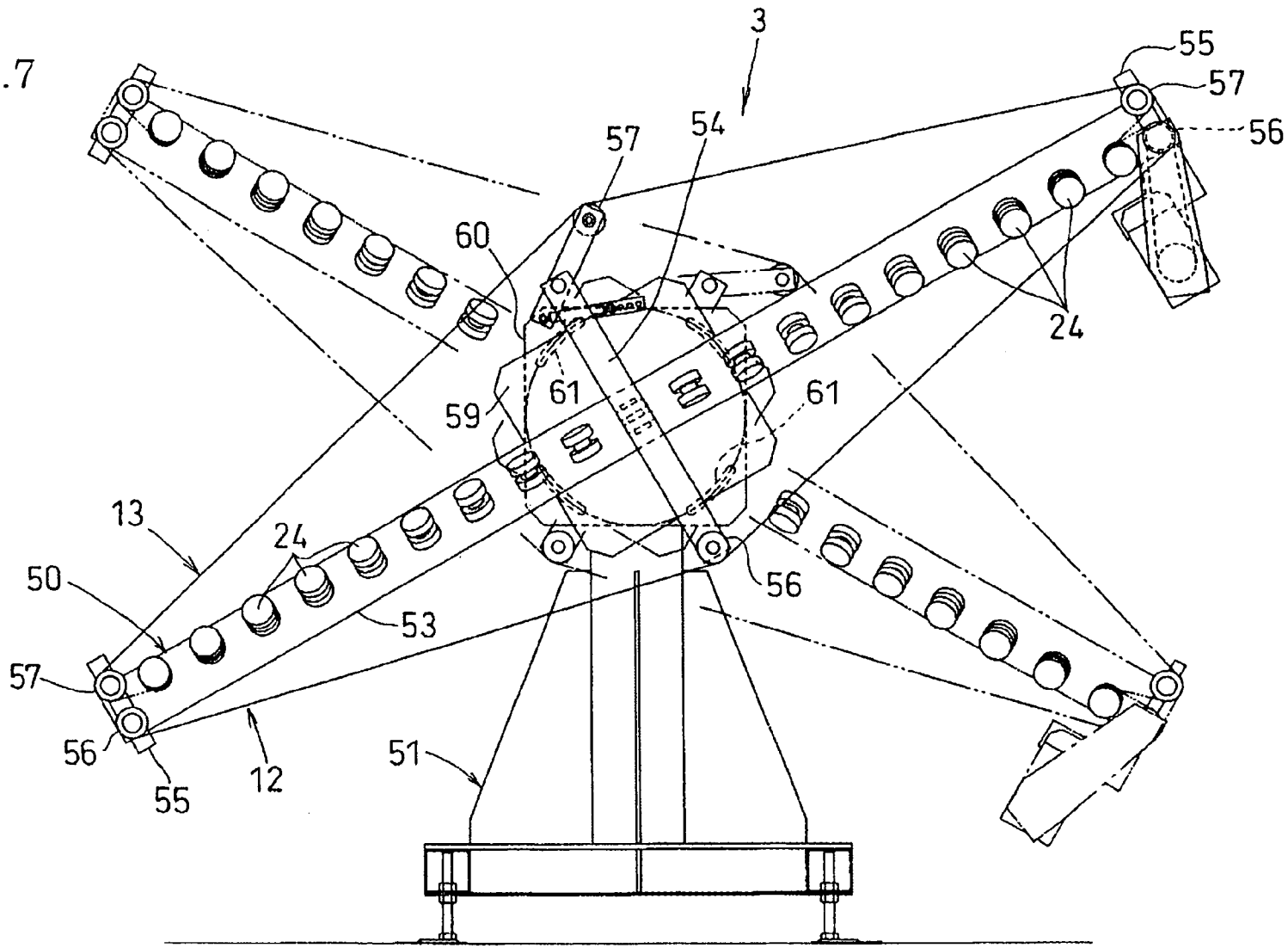
FIG. 7 is a front view showing the secondary conveyer of a straight type.
Figure 8:
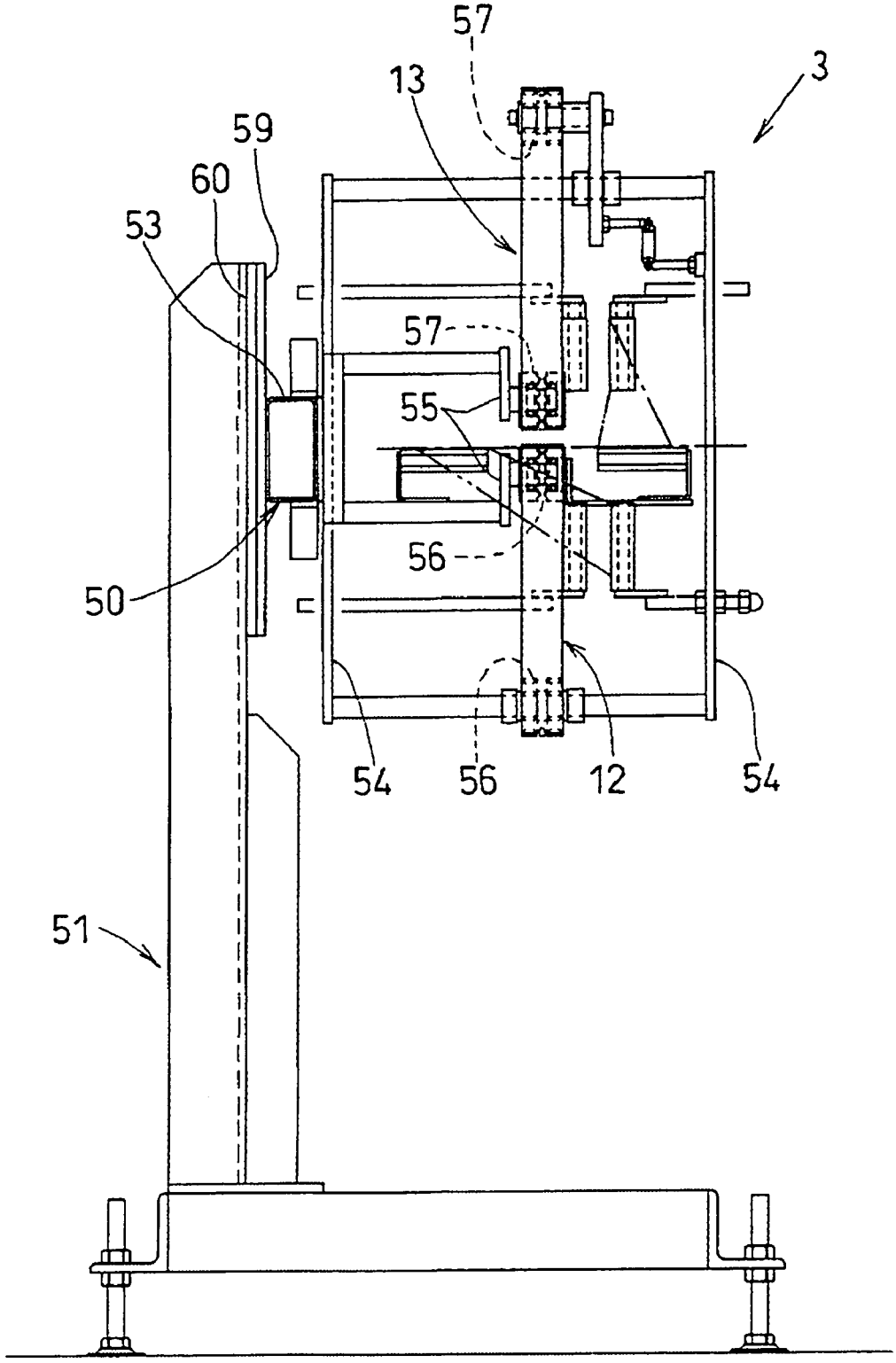
FIG. 8 is a left side view corresponding to FIG. 7.

FIGS. 7 and 8 show a straight type that is adaptable as the secondary conveyer 3. The secondary conveyer 3 of this straight type has a conveyer frame 50 for holding the first guide belt 12 and the second guide belt 13 and an installation frame 51 for supporting this conveyer frame 50.

The conveyer frame 50 has a main bar 53 for holding the guide rollers 24 of the second guide belt 13 in a one-line arrangement. A center bar 54 perpendicular to this main bar 53 is provided in an intermediate part in the lengthwise direction of this main bar 53 and end bars 55 perpendicular to the main bar 53 similarly are provided on both ends thereof. These center bar 54 and end bars 55 hold the tension rollers 56, 57 of the first guide belt 12 and the second guide belt 13.

Incidentally, the secondary conveyer 3 of the example of illustration is configured to transmit driving to one of the tension rollers 56 that the first guide belt 12 has.

The main bar 53 is provided with a rotation substrate 59 in its center of the lengthwise direction, whereas the installation frame 51 is provided with a rotation support plate 60 forming a lower pair with this rotation substrate 59, and these rotation substrate 59 and rotation support plate 60 are connected together with bolts.

In a portion where the rotation substrate 59 and the rotary support plate 60 are connected together with bolts, insertion holes each for a connecting bolt that are provided on either of the plate surfaces so as to penetrate the plate are specified as arc-shape long holes 61 that are arranged on one pitch circle on the plate surface, presenting an arc. This structure makes it possible to alter the rotation angle of the rotation substrate 59 with respect to the rotation support plate 60 along a lengthwise direction of this arc-shape long hole 61.

Incident to the rotation angle alteration of the rotation substrate 59 with respect to this rotation support plate 60, the inclined angle of the conveyer frame 50 with respect to the installation frame 51 (namely, a height alteration of the both ends of the conveyer frame 50 in the conveyance direction) will become alterable.

Therefore, in a case of adopting this secondary conveyer 3, a height between the primary conveyer 2 and the secondary conveyer 3 and a height between the secondary conveyer 3 and the accumulation unit 4 will become adjustable. In a case where the apparatus is configured to be able to adjust a height of the primary conveyer 2 and a height of the accumulation unit 4, this capability leads to adjustability of mutual spacing (installation spacing) between the primary conveyer 2 and the accumulation unit 4.

In addition, since this secondary conveyer 3 itself has the installation frame 51, installation of the secondary conveyer 3 independent from the primary conveyer 2 and the accumulation unit 4 is made possible, and accompanying this, the primary conveyer 2 and the accumulation unit 4 are each made to have a structure enabling independent installation; therefore, these primary conveyer 2, secondary conveyer 3, and accumulation unit 4 will be able to be adjusted independently in mutual installation positions. This is the same also in the secondary conveyer 3 of a curvilinear type explained in FIGS. 1 to 5.

Therefore, by making the primary conveyer 2, the secondary conveyer 3, and the accumulation unit 4 be able to be installed independently in this way, a selection as to whether the secondary conveyer 3 of a curvilinear type explained in FIGS. 1 to 5 is installed between the primary conveyer 2 and the accumulation unit 4 or the secondary conveyer 3 of a straight type explained in FIGS. 7 and 8 is installed therebetween will be able to be performed. In terms of this point, the sheet material accumulating apparatus 1 will be able to be raised in versatility and the degree of freedom of its installation as a whole.

Note that the present invention is not limited to the above-mentioned embodiment, but can be suitably altered according to a form of carrying it out.

For example, in the accumulation unit 4, it is not limited that the posture conversion unit 35 and descend conveyance unit 36 are constructed with the drum type conveyer 37, but the posture conversion unit 35 not having the drum 40 may substitute the posture conversion unit 35.

Therefore, the table top 7 can also be a wide-width strip belt conveyor, or a roller conveyer, or a plate plane whose top face is flat. That is, it is not limited whether it is a driving type or non-driving type.

INDUSTRIAL APPLICABILITY

The present invention is applicable to a use of performing mechanically processing of arranging printed sheets printed by a rotary press in a mutually overlapping state to accumulate them in the form of the columnar body while arranging their orientation, and finally binding them with a binding band.

The invention claimed is:

1. A paper sheet accumulating apparatus, comprising:

a primary conveyer (2); a secondary conveyer (3); and an accumulation unit (4), the primary conveyer (2), secondary conveyer (3), and accumulation unit (4) being arranged in this order following a conveyance flow of a sheet material (W), the accumulation unit (4) including a posture conversion unit (35) for converting the sheet material (W) in a flatted posture into that in a standing posture by guiding the sheet material (W) from one end side thereof to a downward flow and a table top (7) for receiving the sheet material (W) at a lower position of the posture conversion unit (35) and accumulating the sheet material (W) in a longitudinally arranged state while supporting the reached sheet material (W) sequentially in a standup posture, the primary conveyer (2) including a flat conveyance plane (6) for holding the sheet material (W) in a flatted posture at a substantially same height as the table top (7) of the accumulation unit (4), and the secondary conveyer (3) being made able to convey the sheet material (W) received from the primary conveyer (2) in a rise inclined direction so that the sheet material (W) can be delivered by feeding to the posture conversion unit (35) of the accumulation unit (4), and having a first guide belt (12) and a second guide belt (13) that sandwich the sheet material (W) between the first guide belt (12) and the second guide belt (13) and convey the sheet material (W), the first guide belt (12) and the second guide belt (13) keeping parallelism thereof and being twisted along a conveyance direction so that top and bottom of the sheet material (W) being sandwiched is inverted.

2. The sheet material accumulating apparatus according to claim 1, wherein the primary conveyer (2), the secondary conveyer (3), and the accumulation unit (4) are allowed to be installed independently, and regarding the secondary conveyer (3) provided between the primary conveyer (2) and the accumulation unit (4), selection as to whether the secondary conveyer (3) is of a curvilinear type that makes the sheet material (W) take a turn curve to a left or right when its conveyance direction is viewed in a plane or a straight type that makes the sheet material (W) go straight can be done freely.

3. The sheet material accumulating apparatus according to claim 2, wherein the primary conveyer (2) and the accumulation unit (4) are provided in an arrangement such that the conveyance direction of the sheet material (W) is bent to the left or right when viewed in the plane, the secondary conveyer (3) is specified to be of the curvilinear type having a turn curve to the left or right correspondingly to the bend arrangement of these primary conveyer (2) and the accumulation unit (4), and a left/right direction of a twist added to the first guide belt (12) and the second guide belt (13) are the same direction as a left/right direction of the bend added to the turn curve.

4. The sheet material accumulating apparatus according to claim 2, wherein the secondary conveyer (3) is specified to be of the straight type that makes the sheet material (W) go straight in its conveyance direction when viewed in the plane and has a conveyer frame (50) for supporting the first guide belt (12) and the second guide belt (13) and an installation frame (51) for supporting the conveyer frame (50), the conveyer frame (50) and installation frame (51) are connected in a rotation-angle alterable manner so that with an intermediate point of the conveyance span in the conveyer frame (50) acting as a rotation fulcrum, heights of both ends of the conveyer frame (50) in the conveyance direction may be made alterable freely.

5. The sheet material accumulating apparatus according to claim 1, wherein the primary conveyer (2) and the accumulation unit (4) are provided in an arrangement such that the conveyance direction of the sheet material (W) is bent to the left or right when viewed in the plane, the secondary conveyer (3) is specified to be of the curvilinear type having a turn curve to the left or right correspondingly to the bend arrangement of these primary conveyer (2) and the accumulation unit (4), and a left/right direction of a twist added to the first guide belt (12) and the second guide belt (13) are the same direction as a left/right direction of the bend added to the turn curve.

6. The sheet material accumulating apparatus according to claim 1, wherein the secondary conveyer (3) is specified to be of the straight type that makes the sheet material (W) go straight in its conveyance direction when viewed in the plane and has a conveyer frame (50) for supporting the first guide belt (12) and the second guide belt (13) and an installation frame (51) for supporting the conveyer frame (50), the conveyer frame (50) and installation frame (51) are connected in a rotation-angle alterable manner so that with an intermediate point of the conveyance span in the conveyer frame (50) acting as a rotation fulcrum, heights of both ends of the conveyer frame (50) in the conveyance direction may be made alterable freely.

7. The sheet material accumulating apparatus according to claim 1, wherein in the secondary conveyer (3), the first guide belt (12), and the second guide belt (13) are each made up of belt conveyance means (20, 21), and at least one of the belt conveyance means is driven to give conveyance driving to the sheet material (W).

8. The sheet material accumulating apparatus according to claim 1, wherein the flat conveyance plane (6) of the primary conveyer (2) and the table top (7) in the accumulation unit (4) are formed at a height of 700 mm to 1100 mm inclusive from a floor (G) on which an operator (M) stands working in a standup posture.

* * * * *